United States Patent [19]

Doiron

[11] Patent Number: 4,771,490

[45] Date of Patent: Sep. 20, 1988

[54] GRAVITY ACTUATED LOCK

[76] Inventor: Gerald J. Doiron, 40 Franklin St., Athol, Mass. 01331

[21] Appl. No.: 107,156

[22] Filed: Oct. 13, 1987

[51] Int. Cl.[4] ..... A47D 7/02; E05C 17/02

[52] U.S. Cl. ..... 5/100; 292/305

[58] Field of Search ..... 5/93.12, 100, 428, 429; 292/213, 218, 305, 306

[56] References Cited

U.S. PATENT DOCUMENTS

| | | | |
|---|---|---|---|
| 12,833 | 5/1855 | Rode | 292/218 |
| 1,289,988 | 12/1918 | Whitcomb et al. | 5/100 |
| 1,432,190 | 10/1922 | Krueger | 5/100 |
| 1,907,928 | 5/1933 | Kroll | 5/100 |
| 2,955,298 | 10/1960 | Rurka | 5/100 |

FOREIGN PATENT DOCUMENTS

| | | | |
|---|---|---|---|
| 477780 | 1/1938 | United Kingdom | 5/100 |

*Primary Examiner*—Michael F. Trettel
*Attorney, Agent, or Firm*—Charles R. Fay

[57] ABSTRACT

A gravity actuated lock for the e.g. dropside of a crib to hold the dropside elevated. A rotary lock enters a notch on the dropside rod under the influence of a relatively heavy manually manipulated member that is fixed to the rotary lock and actuates it to locking condition, with no spring present or needed. The lock is released by the operator by pulling or pushing upwardly on the member, which is available at the front of the crib.

8 Claims, 2 Drawing Sheets

GRAVITY ACTUATED LOCK

BACKGROUND OF THE INVENTION

There have been many inventions on locks for crib dropsides. These locks preferably are double, one at each end of the crib (and dropside) which are simultaneously operated by the attendant to let the side drop to easier and more safely attend to, or take out or put in the infant. Some are capable of one hand or knee operation to leave a hand or both hands free to attend to the occupant, and many have different advantages and defects, but all are relatively complicated and thus expensive and in some cases difficult to operate or tend to be unsafe under various conditions of operation or care taken. many depend on springs for the locking action.

The primary object of this invention is to present an inexepensive, simplified structure that retains and enhances the positive actuation and safety of the infant to the highest degree, as well as providing increased ease of operation, and no springs for actuaton of the locks.

SUMMARY OF THE DISCLOSURE

Although the dislcosure herein is that of a lock for a crib dropside, there are other situations in which the basis of this invention can be useful. The crib of the present case has four cornerposts, mattress supporting spring frame, an dropside at least at the front, and dropside rods to which the dropside is to be locked in raised condition, all as basically present in modern cribs. The dropside rods herein are mounted on the corner posts in parallel and spaced relation and the dropside runs up and down on the rods with associated lock means thereon to enter holes or notches to hold the dropside raised, and the holes or notches are usually on the drop rods. The above describes many prior devices that are old and well-known.

In the present case, the drop rod notches are pressed (or cut) in the rods and there may be only one notch on each rod, but there could be several notches spaced along the rods for variation in elevation of the dropside. The lock is simply a part of an end to end actuator that is journalled in a lock housing on the rod and affixed to the dropside. The end to end actuator has such a lock at each end thereof, the actuator rotates or partially so, by action of the attendant to relase the locks from there notches so that the dropside descends by gravity. The actuator is offset from the lock or locks and tends to urge the locks by gravity alone into contact with the drop rods and thus into the notches on the drop rods when coincident therewith.

Thus to lock the dropside in up condition, the dropside is merely raised and the locks enter the notches by gravity. To unlock, the attendant merely raises the actuator, thereby rolling or rotating the locks out of the notches to allow the dropside to drop.

PREFERRED EMBODIMENTS OF THE INVENTION

Figure 1:
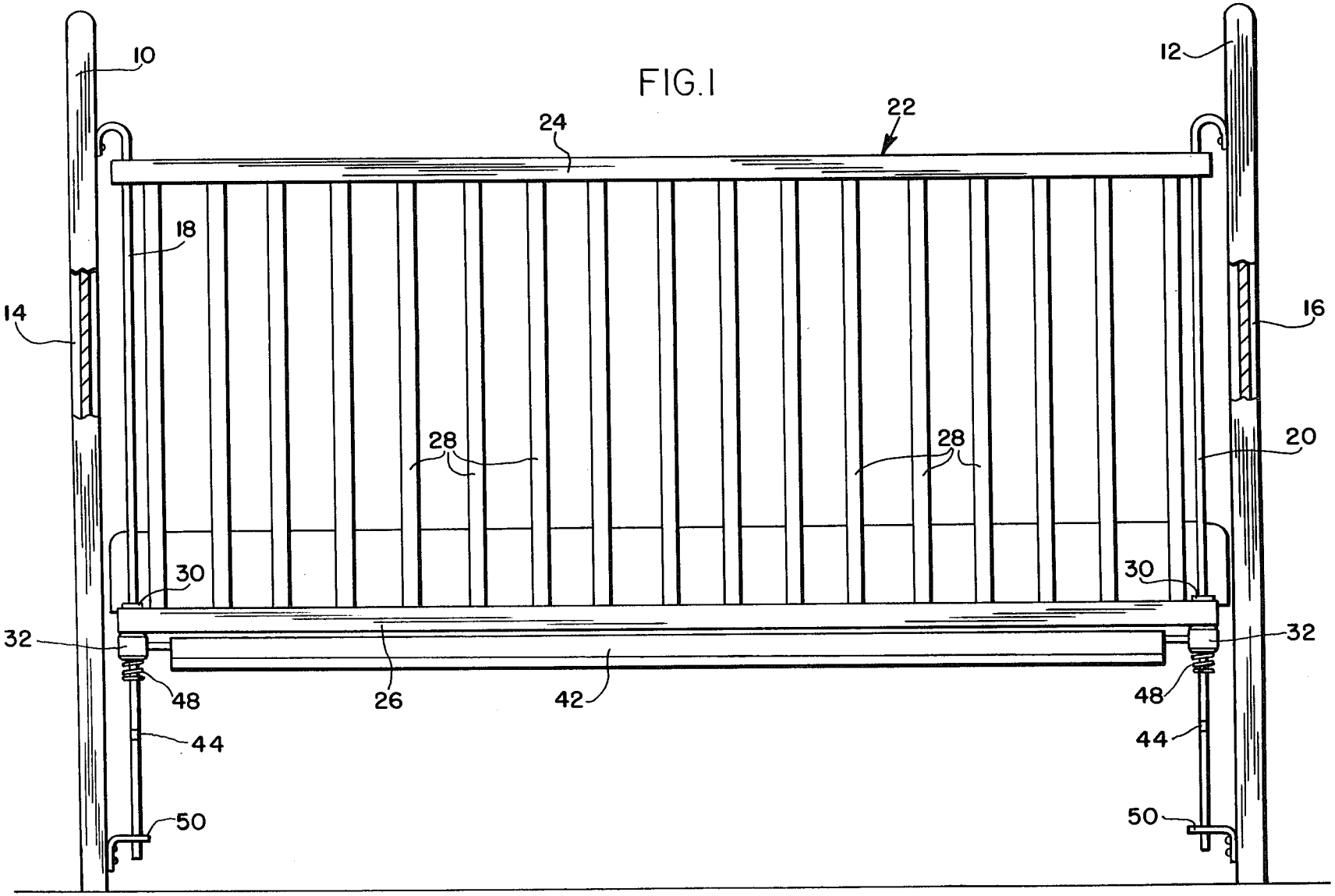
FIG. 1 is a front elevational view showing a dropside crib with the present invention applied thereto, and showing the dropside in raised, locked condition.

This invention is especially adapted to be applied to lock the dropside of a crib and is illustrated in combination with such a crib dropside. The crib, otherwise conventional, has four cornerposts, 10, 12, 14, and 16 and corner posts 10 and 12 slidably mount dropside 22 therebetween. The crib may have a single dropside or there may be a dropside at both front and rear sides. The dropside has the usual upper or top rail 24 and lower rail 26 with interconnecting stiles 28. the rails have openings in the ends thereof to receive the drop rods.

Figure 4:
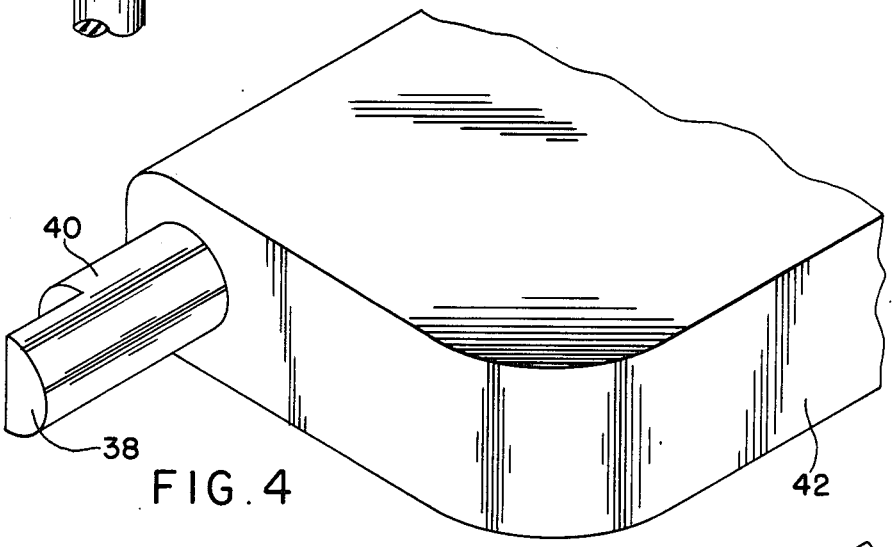
FIG. 4 is a perspective view showing a form of the lock.
Figure 5:
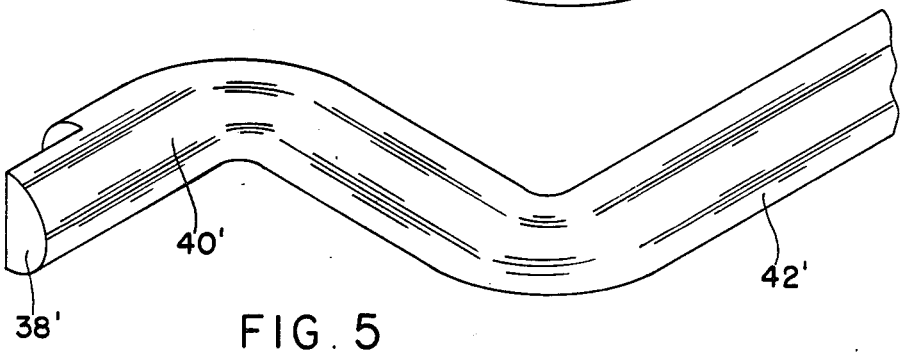
FIG. 5 is a view similar to FIG. 4 but showing a modification.

The lower rail 26 openings for the drop rods are larger than the openings in the top rail and accommodate bushings 30 which rise from lock housings 32 on which the lower rail 26 rests or is secured to, and snap or O-rings at 34 may be used to maintain assembly with the lower rail 26. Each lock housing has a through hole or passage 36 at right angles to the drop rod. This passage is cylindrical and intersects the respective drop rod and rotarily receives the lock member 38 which is exemplified as substantially a semi-cylindrical end on a round rod 40. One form of the invention is shown in FIG. 4 as a pin inserted into a wooden or the like lock bar 42 that extends along the lower rail from end to end of the dropside and is the lock actuator. This lock bar is rotarily (oscillatable) mounted at its ends by the pins 40 in passages 36.

The drop rods 18 and 20 have impressed (or machined) notches 44 that slant down and in and form a lock member surface 46 to receive the lower end of the lock 38 to lock the dropside. Two notches in the drop rod are shown both for clarity in illustration and because the dropside may have two or more locked positions, if wanted. A shock spring 48 may be attached to the lower side of each lock housing 32.

Figure 2:
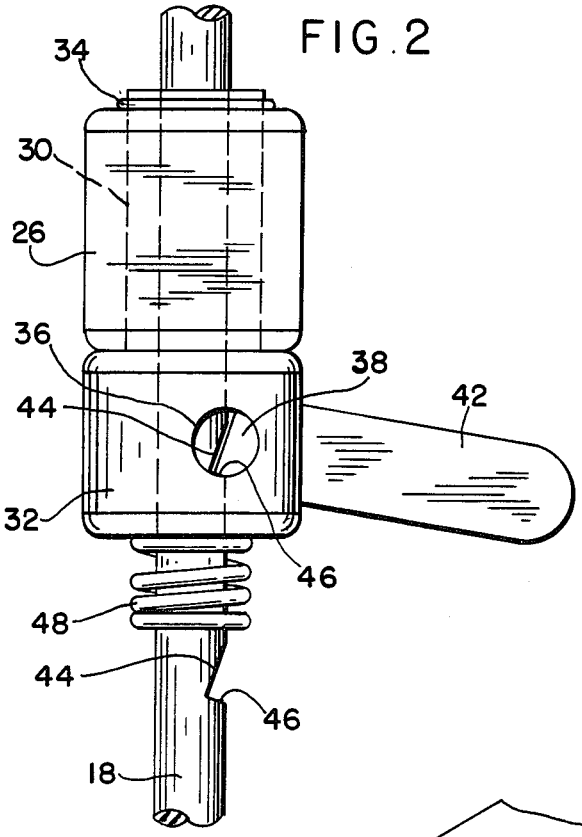
FIG. 2 is a view in end elevation with parts omitted and on a larger scale showing the dropside in raised, locked condition.
Figure 3:
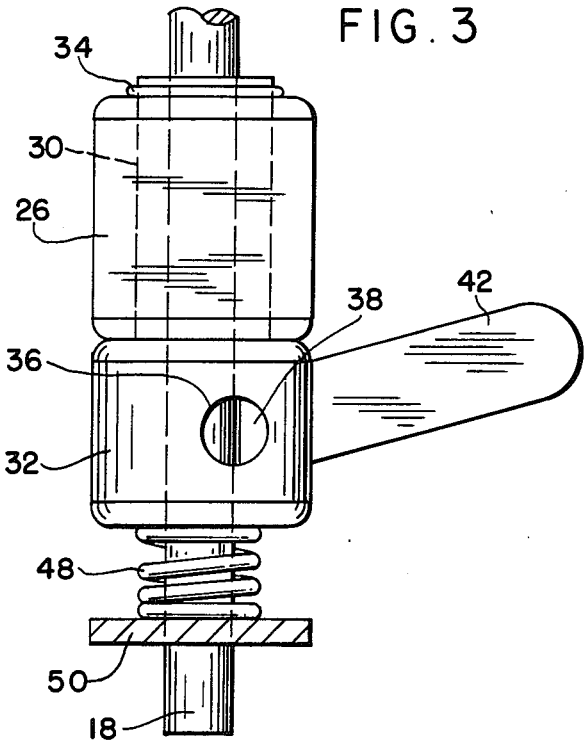
FIG. 3 is a view similar to FIG. 2, but showing the dropside in unlocked condition.

When the dropside is down, the lock is in FIG. 3 position, the lock bar 42 is up, and the lock is free of but slidable on the drop rod. The dropside is actually resting on the drop rod brackets 50. To raise and lock the dropside manually, and when the notch 44 is opposite lock member 38 of the pin 40, the weight of the lock bar 42 causes it to swing inwardly, placing the lock member 3 in the notch, firmly resting on lock surface 46. Thus the locking action is automatic due to gravity and locking condition will be securely maintained until the attendant manually or with knee, swings the lock bar 42 out and up, from its lock position of FIG. 2 to unlocked position, as indicated in FIG. 3, whereupon the dropside drops, down to FIG. 3 condition. A small child will not be able to reach the lock bar to release it.

I claim:

1. A gravity operated lock comprising a rod in substantially upright position, a lock housing on and slidable along the rod, a passage in the housing, an indentation on the rod, said passage being at an angle relative to the rod;

a lock member located in the passage, the passage intersecting the rod, said lock member including a cylindrical part and an adjacent co-axial non-cylindrical part, the cylindrical and non-cylindrical parts being rotatable together, the non-cylindrical part being in position to engage the indentation in the rod, or to free the lock member from the rod to allow the housing to drop by gravity, and means to rotate the lock member manually to free the lock member, said means causing rotation of the lock member to locking position by gravity upon manual release thereof when the lock member is above the indentation in the rod.

2. The gravity lock of claim 1 wherein the means to rotate the lock member significantly adds to the weight of the lock member.

3. The gravity lock of claim 1 wherein the indentation in the rod slants downwardly and inwardly.

4. The gravity lock of claim 1 wherein the uncylindrical part of the lock is substantially semi-cylindrical.

5. A gravity actuated lock for the dropside of a crib having drop rods and a dropside vertically slidable on the rods, said lock comprising a notch in a rod, a lock housing on the dropside and being slidable on the rod, a lock passage in the housing intersecting the rod, and rotarily mounted lock member in the lock passage and having a locking element aligned with the rod, said locking element entering the notch to lock the dropside in one position of rotation and being free of the notch in another positon of rotation, a lock actuator offset from the axis of rotation of the lock being adapted to turn the lock member to notch engaging relation by gravity and to turn the lock member to unengaged position relative to the notch by a rotary motion against gravity, the lock member being cylindrical in part and the locking element being non-cylindrical, said cylindrical and non-cylindrical parts being co-axial to rotate together in the passage.

6. The gravity lock of claim 5 including a bumper spring on the lock housing.

7. The gravity lock of claim 5 including a passage through the lock housing to slidingly receive the drop rod, the passages intersecting at right angles to each other and being relatively offset.

8. In a crib having drop rods and a dropside on the drop rods, a locking system to lock the dropside in up position, said lock being actuated by gravity only, said system comprising a notch on each drop rod, a single element lock actuator extending from drop rod to drop rod, a lock housing at each end of the dropside, a passage through each housing receiving the respective drop rod, a cross lock passage through each housing intersecting the respective drop rod passage, a non-cylindrical lock portion at each end of the actuator, the lock portions being recieved in the lock passages, said lock portions taking up only a part of each lock passage and having adjacent portions of cylindrical form acting as means to journal the lock portions in the lock passages so that the lock portions are rotarily mounted in the lock passages, the lock portions of the actuator being adapted to enter the notches in the drop rods in one rotary position to lock the dropside; and to free the notches in another rotary position thereof to allow the dropside to descend, the actuator being axially offset from the lock portions and having its locking position relatively down and its lock free positions relatively up so that the lock acts to lock by gravity and must be unlocked by being moved bodily upwards against gravity, wherein any additional force exerted downwardly on the actuator acting only to more firmly wedge the lock portions in the notches.

* * * * *